US009841715B2

(12) United States Patent
Miyake

(10) Patent No.: US 9,841,715 B2
(45) Date of Patent: Dec. 12, 2017

(54) IMAGE FORMING APPARATUS, METHOD FOR CONTROLLING IMAGE FORMING APPARATUS

(71) Applicant: KYOCERA Document Solutions Inc., Osaka-shi, Osaka (JP)

(72) Inventor: Masayuki Miyake, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/333,041

(22) Filed: Oct. 24, 2016

(65) Prior Publication Data

US 2017/0139368 A1 May 18, 2017

(30) Foreign Application Priority Data

Nov. 12, 2015 (JP) ..... 2015-221967

(51) Int. Cl.
*G03G 15/00* (2006.01)

(52) U.S. Cl.
CPC ..... *G03G 15/70* (2013.01)

(58) Field of Classification Search
CPC ..... G03G 15/70; G03G 15/65; G03G 15/703; G03G 15/6373; G03G 15/6558
See application file for complete search history.

(56) References Cited

U.S. PATENT DOCUMENTS 5,081,490 A * 1/1992 Wakao ..... G03G 15/234 271/258.01

FOREIGN PATENT DOCUMENTS

JP 61240258 A * 10/1986
JP 01066670 A * 3/1989
JP 2005075569 A 3/2005

* cited by examiner

*Primary Examiner* — David Banh
(74) *Attorney, Agent, or Firm* — Alleman Hall Creasman & Tuttle LLP

(57) ABSTRACT

In an image forming apparatus, includes a sheet supplying portion, an intermediate tray, a discharge tray, a post-processing portion, a jam detecting portion, a discontinuation control portion, a dummy feed control portion, and a supplementary printing control portion. The dummy feed control portion, after the paper jam is solved, causes an image forming portion to execute a dummy feed process in which sheets as many as a predetermined dummy feed number are conveyed from the sheet supplying portion to the intermediate tray, without formation of images on the sheets. The supplementary printing control portion cause the image forming portion to execute a supplementary printing process in which images are formed on one or more sheets, the images being images of remaining pages that are obtained by excluding pages corresponding to the dummy feed number of sheets starting from a beginning page, from all pages.

11 Claims, 7 Drawing Sheets

IMAGE FORMING APPARATUS, METHOD FOR CONTROLLING IMAGE FORMING APPARATUS

INCORPORATION BY REFERENCE

This application is based upon and claims the benefit of priority from the corresponding Japanese Patent Application No. 2015-221967 filed on Nov. 12, 2015, the entire contents of which are incorporated herein by reference.

BACKGROUND

The present disclosure relates to an image forming apparatus and a method for controlling an image forming apparatus.

An image forming apparatus may include a main body portion and a post-processing device, wherein the main body portion includes an image forming portion and the post-processing device is connected to the main body portion. The post-processing device includes a post-processing portion configured to perform a work on a plurality of overlapped sheets collectively. The post-processing portion is, for example, a staple portion configured to perform a sheet binding work to bind a plurality of sheets, or a sheet folding portion configured to perform a sheet folding work to fold a plurality of sheets.

When the post-processing portion executes a process, the image forming portion and a sheet conveying portion that conveys sheets execute a continuous printing process in which images of a plurality of pages are formed on a plurality of sheets. With this process, the plurality of sheets with the images formed thereon are temporarily collected on an intermediate tray in an overlapped state. The post-processing portion executes the post-processing on the plurality of sheets collected on the intermediate tray.

SUMMARY

An image forming apparatus according to an aspect of the present disclosure includes a sheet supplying portion, a pre-processing portion, an intermediate tray, a discharge tray, a post-processing portion, a jam detecting portion, a discontinuation control portion, a dummy feed control portion, a supplementary printing control portion, and a post-supplementary-process control portion. In the sheet supplying portion, sheets are set. The pre-processing portion includes a sheet conveying portion configured to convey the sheets and an image forming portion configured to form images on the sheets. The pre-processing portion is configured to execute a continuous printing process in which a plurality of pages of images are formed on a plurality of sheets while the plurality of sheets are conveyed one by one from the sheet supplying portion along a predetermined conveyance path. The intermediate tray is provided on a downstream side of the conveyance path in a conveyance direction, and configured to temporarily store the plurality of sheets with the images formed thereon. The discharge tray is provided on a downstream side of the intermediate tray in the conveyance direction, and configured to receive the plurality of sheets. The post-processing portion is configured to execute a post-processing in which to perform a predetermined work collectively on the plurality of sheets collected on the intermediate tray, and to discharge a bundle of sheets on which the work was performed, from the intermediate tray to the discharge tray. The jam detecting portion is configured to detect a paper jam of one or more sheets that has occurred in the conveyance path. The discontinuation control portion is configured to, when the paper jam is detected while the continuous printing process is performed by the pre-processing portion, discontinue the continuous printing process until the paper jam is solved. The dummy feed control portion is configured to, after the paper jam is solved, cause the pre-processing portion to execute a dummy feed process in which sheets as many as a predetermined dummy feed number are conveyed from the sheet supplying portion to the intermediate tray, without formation of images on the sheets. The supplementary printing control portion is configured to, after the dummy feed process, cause the pre-processing portion to execute a supplementary printing process in which images are formed on one or more sheets conveyed from the sheet supplying portion, the images being images of remaining pages that are obtained by excluding pages corresponding to the dummy feed number of sheets starting from a beginning page, from all pages that are a target of the continuous printing process. The post-supplementary-process control portion is configured to, after the supplementary printing process, cause the post-processing portion to execute the post-processing.

A method for controlling an image forming apparatus according to another aspect of the present disclosure is a method for controlling an image forming apparatus that includes the sheet supplying portion, the pre-processing portion, the intermediate tray, the discharge tray, the post-processing portion, and the jam detecting portion. The method includes the following steps. One of the steps is a step of, when a paper jam is detected while the continuous printing process is performed by the pre-processing portion, discontinuing the continuous printing process until the paper jam is solved. Another one of the steps is a step of, after the paper jam is solved, causing the pre-processing portion to execute a dummy feed process in which a predetermined dummy feed number of sheets are conveyed from the sheet supplying portion to the intermediate tray, without formation of images on the sheets. A further one of the steps is a step of, after the dummy feed process, causing the pre-processing portion to execute a supplementary printing process in which images are formed on one or more sheets conveyed from the sheet supplying portion, the images being images of remaining pages that are obtained by excluding pages corresponding to the dummy feed number of sheets starting from a beginning page, from all pages that are a target of the continuous printing process. A further one of the steps is a step of, after the supplementary printing process, causing the post-processing portion to execute the post-processing.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the attached drawings. It should be noted that the following embodiment is an example of a specific embodiment of the present disclosure and should not limit the technical scope of the present disclosure.

[Configuration of Image Forming Apparatus 10]

Figure 1:
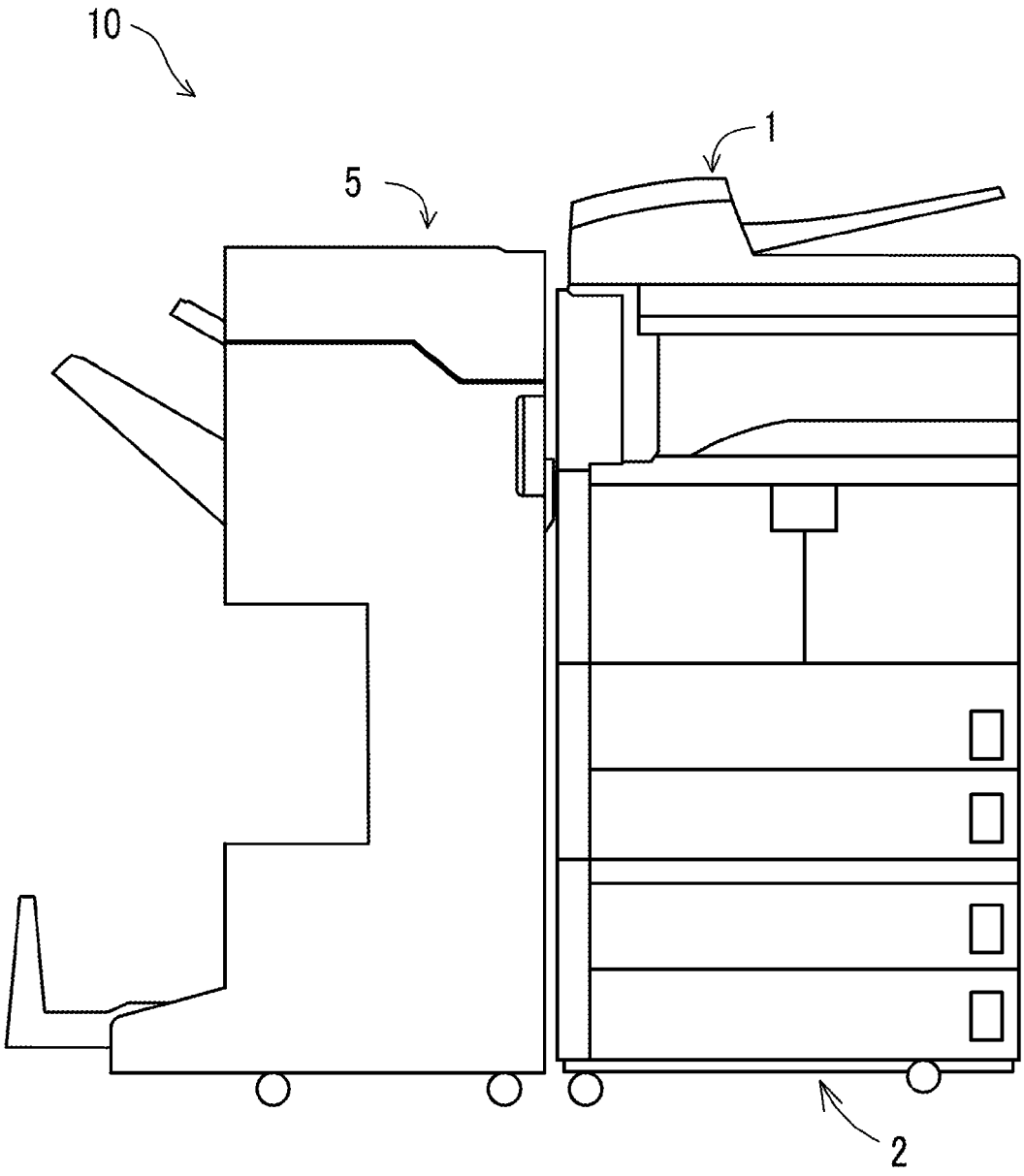
FIG. 1 is a configuration diagram of an image forming apparatus according to an embodiment of the present disclosure.

First, a description is given of a configuration of an image forming apparatus 10 according to the embodiment with reference to FIG. 1 to FIG. 4. The image forming apparatus 10 shown in FIG. 1 is a multifunction peripheral including an image reading function, an image forming function, and a post-processing function.

The image forming apparatus 10 includes an image reading portion 1, a main body portion 2, and a post-processing portion 5. The main body portion 2 includes a sheet supplying portion 30, a sheet conveying portion 3, and an image forming portion 40. The image forming apparatus 10 also includes a control portion 8, an operation display portion 80, and a plurality of sheet sensors 800 (see FIG. 2). It is noted that the image forming apparatus 10 may not include the image reading portion 1.

[Image Reading Portion 1 and Main Body Portion 2]

The image reading portion 1 is a device that reads an image from a document sheet. When the image forming apparatus 10 executes a copy job, the image forming portion 40 forms an image on a sheet 9 based on image data of the document sheet, wherein the image data is output from the image reading portion 1. In addition, when executing a print job received from a terminal (not shown), the image forming portion 40 forms an image on the sheet 9 based on the print job.

The sheet supplying portion 30 is a cassette or a tray on which a plurality of sheets 9 are set. In the present embodiment, the image forming apparatus 10 includes a plurality of sheet supplying portions 30. The plurality of sheet supplying portions 30 include a sheet cassette 30*a* and a manual feed tray 30*b*. The sheet 9 is a sheet-like image formation medium such as a sheet of paper.

The sheet conveying portion 3 is a mechanism for conveying, along conveyance paths 300 to 305 provided in the apparatus, sheets 9 fed one by one from the sheet supplying portions 30. The sheet conveying portion 3 is provided in the main body portion 2 and the post-processing portion 5.

The sheet conveying portion 3 includes a plurality of pairs of conveyance rollers 32 and a plurality of route switching portions 33, wherein the pairs of conveyance rollers 32 convey the sheet 9, and the route switching portions 33 change, by pivoting, directions in which the sheet 9 is guided.

Figure 2:
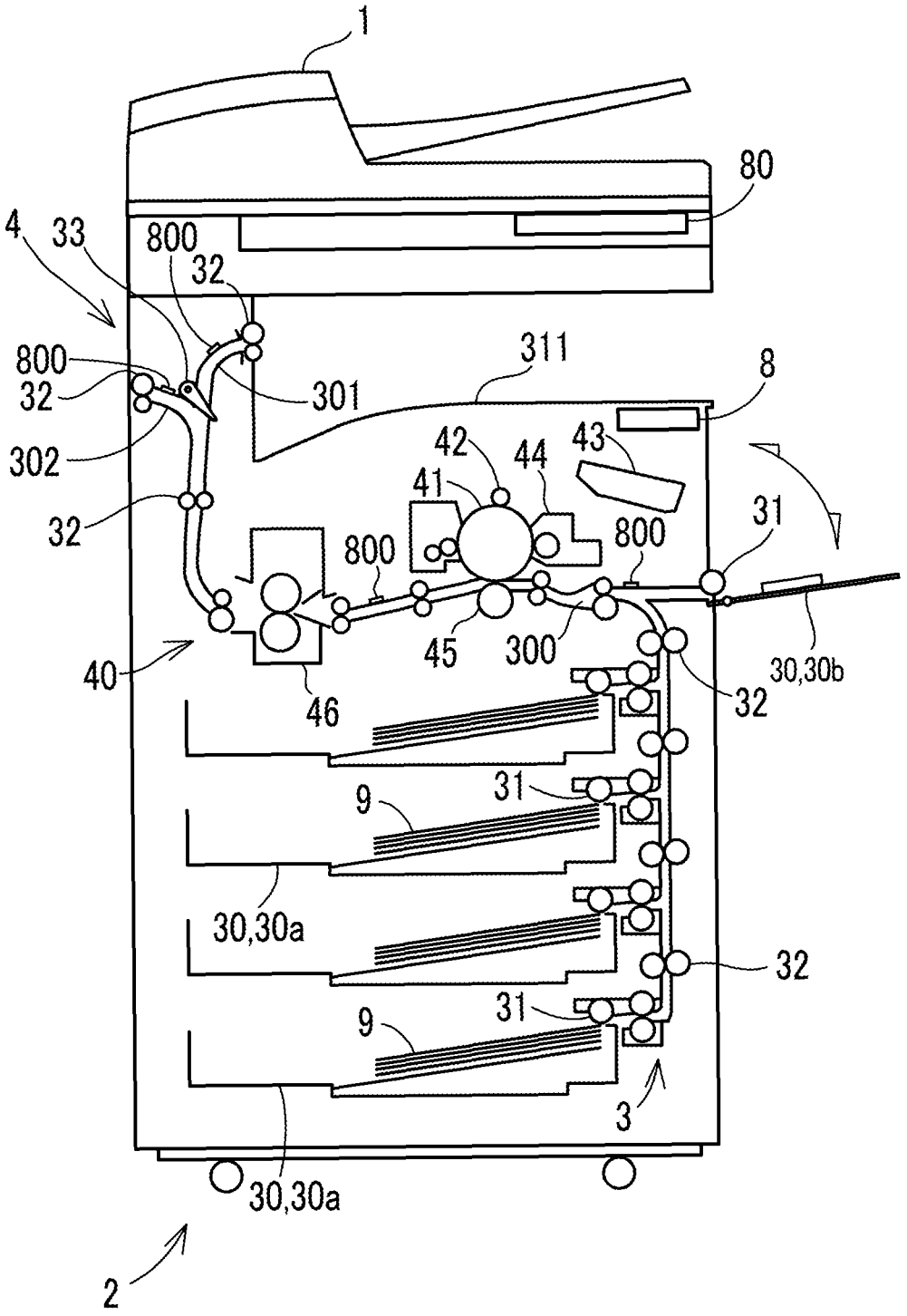
FIG. 2 is a configuration diagram of an image reading portion and an image forming portion of the image forming apparatus according to the embodiment of the present disclosure.

For example, the sheet conveying portion 3 can convey the sheet 9 from the sheet supplying portion 30 along a main conveyance path 300 and a first conveyance path 301, and discharge it to a first discharge tray 311 (see FIG. 2).

Figure 3:
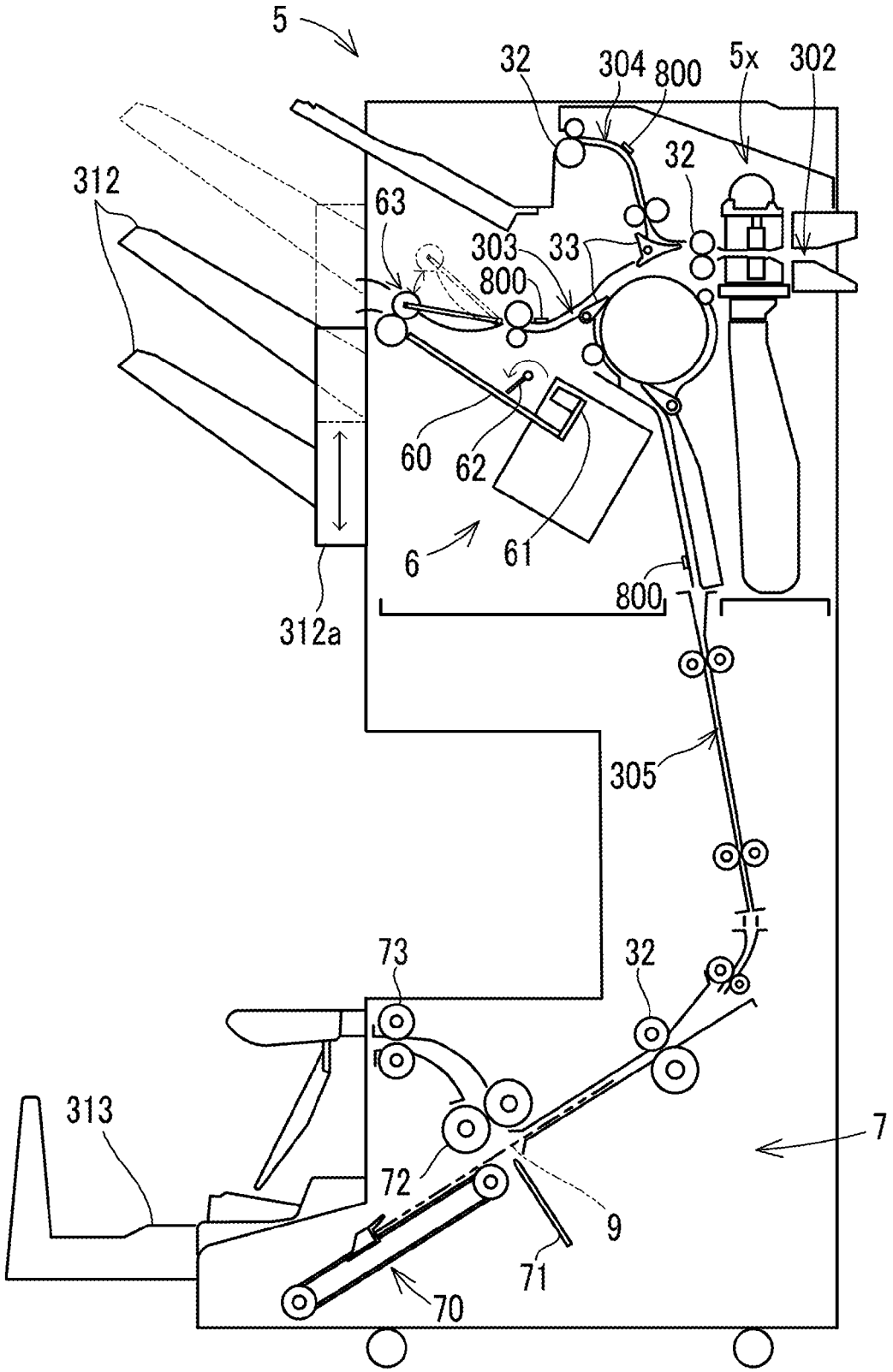
FIG. 3 is a configuration diagram of a post-processing portion of the image forming apparatus according to the embodiment of the present disclosure.
Figure 4:
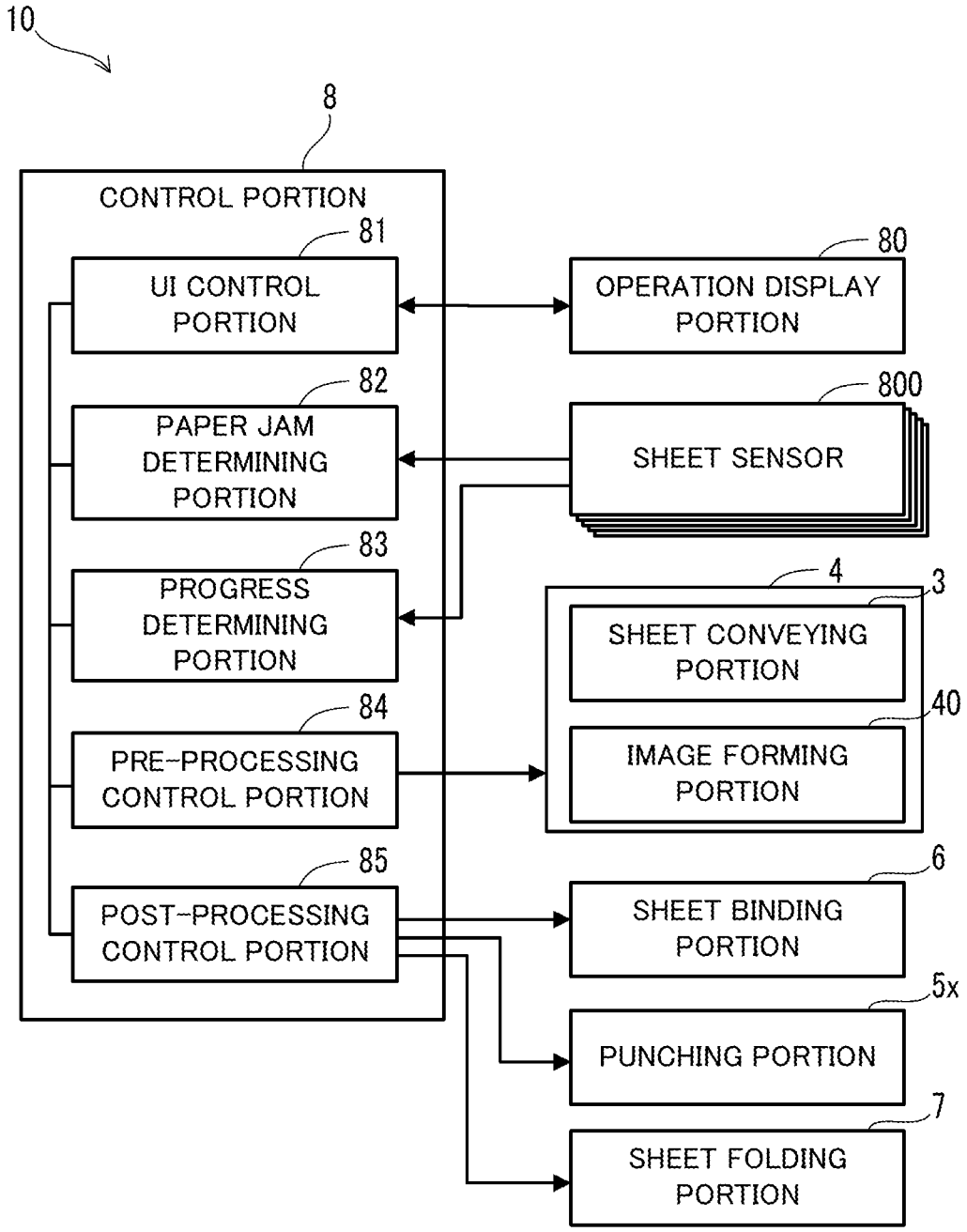
FIG. 4 is a block diagram of control-related equipment of the image forming apparatus according to the embodiment of the present disclosure.

In addition, the sheet conveying portion 3 can convey the sheet 9 from the sheet supplying portion 30 along the main conveyance path 300, a second conveyance path 302 and a third conveyance path 303, to an intermediate tray 60 in the post-processing portion 5 (see FIG. 2 and FIG. 3). It is noted that the third conveyance path 303 and a part of the second conveyance path 302 are formed in the post-processing portion 5.

In addition, the sheet conveying portion 3 can convey the sheet 9 from the sheet supplying portion 30 along the main conveyance path 300 and the second conveyance path 302, to a fourth conveyance path 304 or a fifth conveyance path 305 (see FIG. 2 and FIG. 3).

The image forming portion 40 shown in FIG. 2 executes an image forming process by the electrophotography. In this case, the image forming portion 40 includes a drum-like photoconductor 41, a charging portion 42, a laser scan unit 43, a developing portion 44, a transferring portion 45, and a fixing portion 46. It is noted that the image forming portion 40 may perform the image forming process by another method such as the ink jet method.

The image forming portion 40 forms an image on the surface of the sheet 9 while the sheet 9 is moving along the main conveyance path 300. Hereinafter, the sheet conveying portion 3 and the image forming portion 40 are referred to as a pre-processing portion 4.

[Post-Processing Portion 5]

The post-processing portion 5 is configured to perform processing on sheets 9 that are conveyed from the main body portion 2 after image formation thereon. The post-processing portion 5 includes the intermediate tray 60 on the downstream side of the third conveyance path 303 in the conveyance direction such that a plurality of sheets 9 with images formed thereon are temporarily collected on the intermediate tray 60. The intermediate tray 60 is formed in an inclined state with respect to the horizontal direction. A second discharge tray 312 is provided on the downstream side of the intermediate tray 60 in the conveyance direction.

In the example shown in FIG. 3, the post-processing portion 5 includes a sheet binding portion 6. The sheet binding portion 6 includes a stapling portion 61, a sheet aligning portion 62, and a pair of discharge rollers 63.

The sheet binding portion 6 executes a sheet binding work to bind a plurality of sheets 9 collected on the intermediate tray 60. For example, the sheet binding portion 6 is a stapler that binds the plurality of sheets 9 by a metal staple or the like.

The pair of discharge rollers 63 are configured to discharge a bundle of sheets 9 that have been bound together by the sheet binding work, from the intermediate tray 60 to the second discharge tray 312. The pair of discharge rollers 63 are switched between a closed state and an open state by one of the pair of discharge rollers 63 being displaced, wherein in the closed state, the two rollers are located close to each other, and in the open state, the two rollers are separate from each other.

In the present embodiment, the post-processing portion 5 includes a plurality of second discharge trays 312 on the downstream side of the intermediate tray 60 in the conveyance direction. The plurality of second discharge trays 312 are supported by a lifting and lowering mechanism 312*a* so as to be movable up and down.

The lifting and lowering mechanism 312*a* lifts and lowers the plurality of second discharge trays 312 all at once so that one of the plurality of second discharge trays 312 is disposed at a position where it can receive the sheets 9 discharged by the pair of discharge rollers 63. This makes it possible to select, from among the plurality of second discharge trays 312, a discharge destination of the sheets 9 from the intermediate tray 60.

When a sheet 9 is conveyed from the third conveyance path 303 to the intermediate tray 60, the sheet 9 falls on the intermediate tray 60 while a part of the front side of the sheet 9 goes into between the pair of discharge rollers 63 in the open state.

The sheet aligning portion 62 aligns the lower edge of the sheet 9 with the lower edge of the intermediate tray 60 by pivoting while contacting the sheet 9 that fell on the intermediate tray 60. The sheet aligning portion 62 pivots at a position facing the intermediate tray 60. The sheet aligning portion 62 is, for example, an elastic member such as a plate-like rubber member.

The pair of discharge rollers 63 move from the open state to the closed state in a state where one or more sheets 9 are present on the intermediate tray 60, and then rotate such that the one or more sheets 9 are discharged from the intermediate tray 60 onto the second discharge tray 312.

In the following description, a sheet binding process refers to a process in which the sheet binding portion 6 performs the sheet binding work to collectively bind a plurality of sheets 9 stored on the intermediate tray 60, and the pair of discharge rollers 63 discharge a bundle of sheets 9 that have been bound together by the sheet binding work, from the intermediate tray 60 to the second discharge tray 312. It is noted that the sheet binding process is an example of the post-processing, and the sheet binding portion 6 is an example of the post-processing portion.

When the sheet binding portion 6 executes the sheet binding process, the pre-processing portion 4 executes a continuous printing process. In the continuous printing process, a plurality of sheets 9 are conveyed one by one from the sheet supplying portion 30 along the main conveyance path 300, the second conveyance path 302 and the third conveyance path 303, and a plurality of pages of images are formed on the plurality of sheets 9.

In the following description, the number of sheets 9 that are processed in one continuous printing process is referred to as a unit number of sheets. When the unit number of sheets 9 are collected on the intermediate tray 60, the sheet binding portion 6 performs the sheet binding process.

In addition, the pre-processing portion 4 may execute a copy-unit printing process in which the continuous printing process is repeated as many times as a specified number of copies that has been set in advance. In this case, the sheet binding portion 6 executes a copy-unit sheet binding process. In the copy-unit sheet binding process, the sheet binding process is performed each time the unit number of sheets 9 are collected on the intermediate tray 60 in the copy-unit printing process. It is noted that the copy-unit sheet binding process is an example of the copy-unit post-processing.

In the example shown in FIG. 3, the post-processing portion 5 also includes a punching portion 5*x* and a sheet folding portion 7. The punching portion 5*x* performs a punching work to form a punching hole in each sheet 9 that is being conveyed in the second conveyance path 302. Another intermediate tray 70 is provided on the downstream side of the fifth conveyance path 305, and a third discharge tray 313 is provided on the downstream side of the intermediate tray 70 in the conveyance direction.

The sheet folding portion 7 performs a sheet folding work to fold a plurality of sheets 9 collected on the intermediate tray 70, and discharge a bundle of sheets 9 that have been folded by the sheet folding work to the third discharge tray 313. The sheet folding portion 7 includes a blade 71, a pair of sheet folding rollers 72, and a pair of discharge rollers 73. The blade 71 pushes a plurality of overlapped sheets 9 into a nip portion of the pair of sheet folding rollers 72, and the pair of sheet folding rollers 72 form a fold on the sheets 9. The pair of discharge rollers 73 discharge a bundle of sheets 9 that have been passed through the pair of sheet folding rollers 72 onto the third discharge tray 313.

The plurality of sheet sensors 800 are configured to detect each sheet 9 that is being conveyed along the conveyance paths. The sheet sensors 800 may be, for example, reflection-type photosensors or transmission-type photosensors.

The plurality of sheet sensors 800 are disposed at a plurality of locations along a route from the sheet supplying portion 30 to the intermediate tray 60 via the main conveyance path 300, the second conveyance path 302 and the third conveyance path 303. In the example shown in FIG. 2 and FIG. 3, the sheet sensors 800 are provided also in the first conveyance path 301, the fourth conveyance path 304 and the fifth conveyance path 305.

The sheet sensors 800 can detect a paper jam of one or more sheets 9. In addition, at least one sheet sensor 800 is provided in the third conveyance path 303. The third conveyance path 303 is located at a position where a sheet 9 passes through before going above the intermediate tray 60. The sheet sensor 800 of the third conveyance path 303 can also detect the number of sheets 9 collected on the intermediate tray 60.

The operation display portion 80 includes an operation portion and a display portion, wherein the operation portion receives operations of inputting information and the display portion displays information. For example, the operation portion and the display portion may be a touch panel unit that includes a touch panel and a display panel on which the touch panel is formed.

The control portion 8 controls the image reading portion 1, the pre-processing portion 4, the post-processing portion 5 and the operation display portion 80. Furthermore, the control portion 8 performs various types of determination processes and calculation processes based on detection results of the sheet sensors 800.

As one example, the control portion 8 may include a MPU (Micro Processor Unit) and a RAM (Random Access Memory), wherein the MPU executes programs stored in a nonvolatile, computer-readable storage portion (not shown). In addition, the control portion 8 may be a combination of one or more of the MPU, an ASIC (Application Specific Integrated Circuit), and a DSP (Digital Signal Porcessor).

In the control portion 8, an UI control portion 81 controls the operation display portion 80. In addition, a paper jam determining portion 82 of the control portion 8 determines whether or not a paper jam has occurred and the location of the paper jam, based on a successive detection time period of a sheet 9 by the sheet sensors 800.

Specifically, when a certain sheet sensor 800 detects a sheet 9 successively for over a predetermined upper-limit time period, the paper jam determining portion 82 determines that a paper jam has occurred at a position where the sheet sensor 800 is located.

The plurality of sheet sensors 800 and the paper jam determining portion 82 are an example of the paper jam detecting portion that detects a paper jam of one or more sheets 9 in the conveyance paths 300 to 305.

In addition, in the control portion 8, a progress determining portion 83 determines a progress state of the continuous printing process and the copy-unit printing process. As one example, the progress determining portion 83 determines the number of sheets 9 collected on the intermediate tray 60 by counting the number of times that the sheet sensor 800 of the third conveyance path 303 detected a passage of a sheet 9 after the pair of discharge rollers 63 had last discharged sheets 9.

The count value of the number of times that the sheet sensor 800 of the third conveyance path 303 detected a passage of a sheet 9, is reset each time it reaches the unit number of sheets. Each time the count value reaches the unit number of sheets, the progress determining portion 83 outputs an event for the operation of the pair of discharge rollers 63.

Furthermore, while the copy-unit printing process and the copy-unit sheet binding process are executed, each time the count value reaches the unit number of sheets, the progress determining portion 83 counts up the number of copies that were bound together by the sheet binding process. This enables the progress determining portion 83 to calculate the number of copies on which the sheet binding process was completed.

In addition, in the control portion 8: a pre-processing control portion 84 controls the pre-processing portion 4 that includes the sheet conveying portion 3 and the image forming portion 40; and a post-processing control portion 85 controls the sheet binding portion 6, the punching portion 5*x* and the sheet folding portion 7.

Meanwhile, in general, when a paper jam of one or more sheets 9 is detected while the continuous printing process is executed, the continuous printing process is discontinued. In a conventional image forming apparatus, after the user removes all of the sheets 9 from the apparatus and the paper jam is solved, the continuous printing process is performed again from the beginning.

However, there may be a case where one or more sheets 9 with images formed thereon have been collected on the intermediate tray 60 before the continuous printing process is discontinued. In this case, if both the sheets 9 involved in the paper jam and the sheets 9 collected on the intermediate tray 60 are discarded, the process resumed after the paper jam solution consumes sheets 9, developer and time wastefully.

In the image forming apparatus 10, too, when a paper jam occurs, the continuous printing process is discontinued and the post-processing that is performed on a plurality of sheets 9 collected on the intermediate tray 60 during the continuous printing process, is also discontinued. However, with the adoption of the image forming apparatus 10, a control described below is executed, and it is possible to prevent the process resumed after the paper jam solution from consuming sheets 9, developer and time wastefully.

[Copy-Unit Control]

Next, an example of the procedures of a copy-unit control executed by the control portion 8 is described with reference to the flowchart shown in FIG. 5. In the following description, S101, S102, . . . are identification signs representing the steps executed by the control portion 8.

<Step S101>

When a start event for the copy-unit printing process and the copy-unit sheet binding process occurs, the control portion 8 starts the copy-unit control. The start event is that a predetermined start operation is performed on the operation portion of the operation display portion 80, or that a job is received from an external apparatus via a communication interface (not shown).

The copy-unit control is a control in which the pre-processing control portion 84 causes the pre-processing portion 4 to execute the copy-unit printing process, and the post-processing control portion 85 causes the sheet binding portion 6 to execute the copy-unit sheet binding process. It is noted that the pre-processing control portion 84 and the post-processing control portion 85 that execute the copy-unit control are an example of the copy-unit control portion.

<Step S102>

While the copy-unit control is performed, the progress determining portion 83 determines a progress state of the continuous printing process and the copy-unit printing process.

<Step S103>

Furthermore, while the copy-unit control is performed, the paper jam determining portion 82 determines whether or not a paper jam has occurred.

<Step S104>

When the progress determining portion 83 determines that the copy-unit printing process and the copy-unit sheet binding process have been completed without occurrence of a paper jam, the pre-processing control portion 84 and the post-processing control portion 85 end the copy-unit control.

<Step S105>

On the other hand, when a paper jam is detected while the continuous printing process is performed during the copy-unit printing process, the control portion 8 executes a paper jam control described below. Thereafter, the control portion 8 ends the copy-unit control.

[Paper Jam Control]

Next, an example of the procedures of a paper jam control executed by the control portion 8 is described with reference to the flowchart shown in FIG. 6. In the following description, S201, S202, . . . are identification signs representing the steps executed by the control portion 8.

<Step S201>

When a paper jam is detected while the continuous printing process is performed, the pre-processing control portion 84 discontinues the continuous printing process that has been performed by the pre-processing portion 4, until the paper jam is solved. The pre-processing control portion 84 that executes the process of step S201 is an example of the discontinuation control portion.

It is noted that if the unit number of sheets 9 have been collected on the intermediate tray 60 when the paper jam is detected, the post-processing control portion 85 causes the sheet binding process that has been started and is in the middle of the process, to be completed, or causes the sheet binding process that has not yet been started, to be started and completed.

<Step S202>

The UI control portion 81 outputs an error notification that represents a paper jam occurrence status, to the display portion of the operation display portion 80.

<Step S203>

The progress determining portion 83 determines whether or not one or more sheets 9 less than the unit number of sheets are present in the intermediate tray 60. It is noted that the number of sheets 9 that are present in the intermediate tray 60 in step S203 is the number of sheets 9 that had been conveyed to the intermediate tray 60 during the continuous printing process before the process was discontinued.

When the progress determining portion 83 determines that no sheet 9 is present in the intermediate tray 60, steps S204 and S205 are skipped, and the process moves to step S206.

<Step S204>

When, in step S203, the progress determining portion 83 determines that one or more sheets 9 less than the unit number of sheets are present in the intermediate tray 60, the post-processing control portion 85 executes a remaining sheet discharge control. The remaining sheet discharge control is a control to cause the sheet binding portion 6 not to perform the sheet binding process, but to discharge the sheets 9 remaining in the intermediate tray 60, to the second discharge tray 312.

It is noted that the remaining sheet discharge control (S204) is executed at least before the next step S205 (a dummy feed process) is executed. The post-processing control portion 85 that executes the process of step S204 is an example of the remaining sheet discharge control portion.

On the sheets 9 discharged in step S204, images of pages starting from the starting page, among all pages that are the target of the continuous printing process, have been formed. The sheets 9 discharged in step S204 are not discarded, but used effectively later. The use form is described below.

<Step S205>

The progress determining portion 83 sets, as a dummy feed number, the number of sheets 9 that were determined to be present in the intermediate tray 60 in step S203. The dummy feed number is referred to in step S306 of FIG. 7 described below. The progress determining portion 83 that executes the process of step S205 is an example of the dummy feed number automatic setting portion.

When the unit number of sheets is five, for example, and a paper jam occurs after the second sheet 9 is conveyed and before the third sheet 9 is conveyed to the intermediate tray 60 in the continuous printing process, the dummy feed number is set to two.

<Step S206>

The progress determining portion 83 calculates the succeeding number of copies. The succeeding number of copies is obtained by subtracting, from the specified number of copies, the number of copies that is obtained by adding one to the number of copies on which the sheet binding process had been completed before the continuous printing process was discontinued.

The succeeding number of copies is referred to in step S301 of FIG. 7 that is described below. It is noted that the progress determining portion 83 that executes the process of step S206 is an example of the succeeding copy number calculating portion.

Suppose that the specified number of copies is four, and a paper jam occurs after binding of two copies of sheets have been completed and before the unit number of sheets 9 are collected on the intermediate tray 60 during the copy-unit sheet binding process, then the succeeding number of copies is calculated as one from (4−(2+1)).

<Step S207>

The paper jam determining portion 82 determines whether or not the paper jam has been solved. The discontinuation of the continuous printing process is maintained until the paper jam determining portion 82 determines that the paper jam has been solved.

It is noted that the paper jam is solved when the user remove the sheets 9 that were involved in the paper jam, from the conveyance paths 300 to 305.

<Step S208>

When the paper jam determining portion 82 determines that the paper jam has been solved, the control portion 8 executes a post-jam-solution control. With the execution of the post-jam-solution control, the paper jam control is completed.

[Post-Jam-Solution Control]

Next, an example of the procedures of the post-jam-solution control executed by the control portion 8 is described with reference to the flowchart shown in FIG. 7. In the following description, S301, S302, . . . are identification signs representing the steps executed by the control portion 8.

<Step S301>

After the paper jam is solved, the control portion 8 executes a succeeding control. In the succeeding control, the pre-processing control portion 84 and the post-processing control portion 85 cause the pre-processing portion 4 and the sheet binding portion 6 to perform the copy-unit printing process and the copy-unit sheet binding process on the succeeding number of copies calculated in step S206.

In other words, during step S301, the pre-processing control portion 84 and the post-processing control portion 85 cause the pre-processing portion 4 and the sheet binding portion 6 to perform the copy-unit printing process and the copy-unit sheet binding process, with the succeeding number of copies being set as the specified number of copies.

It is noted that the pre-processing control portion 84 and the post-processing control portion 85 that execute the process of step S301 are an example of the succeeding control portion.

As explained above, when the specified number of copies is four, and a paper jam occurs after binding of two copies of sheets have been completed and before the unit number of sheets 9 are collected on the intermediate tray 60 during the copy-unit sheet binding process, the succeeding number of copies is calculated as one. In this case, the copy-unit printing process and the copy-unit sheet binding process are performed, with 1 (one) being set as the specified number of copies.

Figure 6:
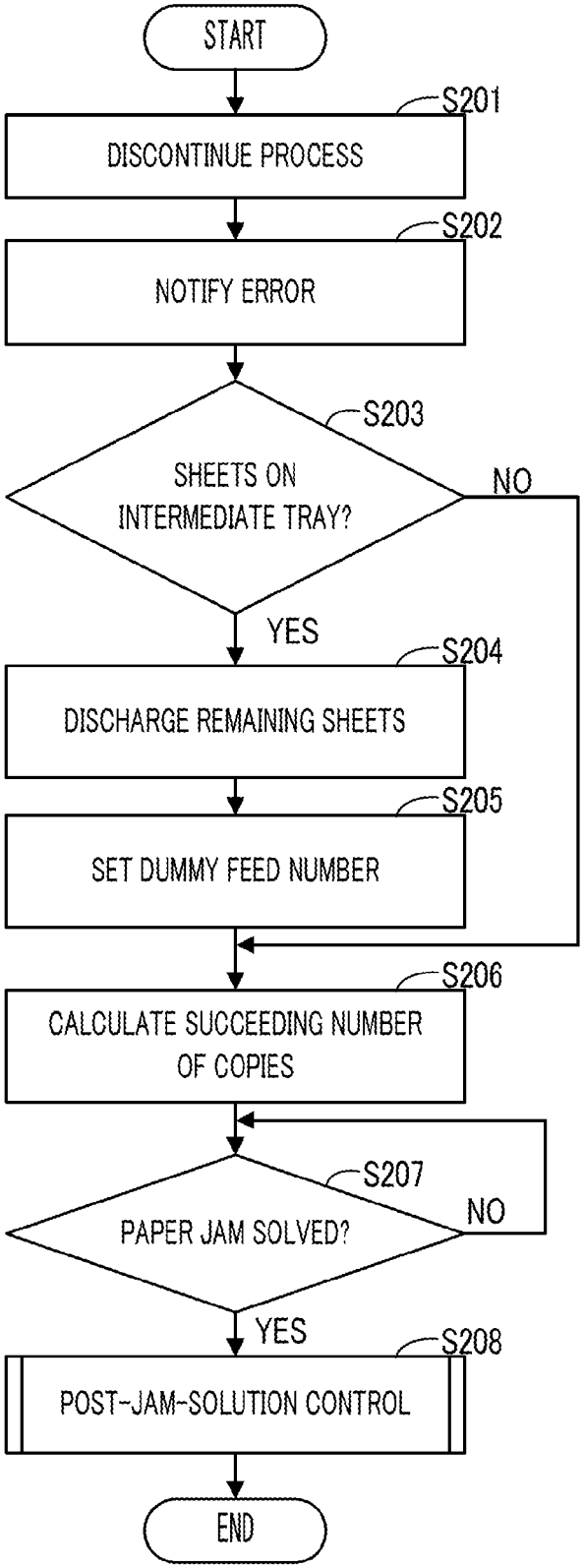
FIG. 6 is a flowchart showing an example of procedures of a paper jam control in the image forming apparatus according to the embodiment of the present disclosure.

During the succeeding control performed in step S301, the post-processing control portion 85 causes the sheet binding portion 6 to discharge a bundle of sheets 9 to a second discharge tray 312 that is different from the second discharge tray 312 to which the sheets 9 were discharged during the remaining sheet discharge control (S204 of FIG. 6).

That is, the post-processing control portion 85 switches between the second discharge trays 312 as the discharge destinations, by controlling the lifting and lowering mechanism 312*a*, and then causes the sheet binding portion 6 to execute the process of discharging the bundle of sheets 9.

For example, there may be a case where, during the copy-unit control (S101 of FIG. 5) and the remaining sheet discharge control (S204 of FIG. 6), sheets 9 are discharged from the intermediate tray 60 to a same second discharge tray 312. When the second discharge tray 312 in that case is the first-tier tray, sheets are discharged from the intermediate tray 60 to the second discharge tray 312 of the second-tier during the succeeding control (S301).

In addition, there may be a case where, during the copy-unit control (S101 of FIG. 5), sheets 9 are discharged from the intermediate tray 60 to the second discharge tray 312 of the first-tier, and during the remaining sheet discharge control (S204 of FIG. 6), sheets 9 are discharged from the intermediate tray 60 to the second discharge tray 312 of the second-tier. In this case, during the succeeding control (S301), sheets 9 may be discharged from the intermediate tray 60 to the second discharge tray 312 of the first-tier.

This prevents the sheets 9 discharged in step S204 on which the sheet binding process has not been performed, from being embedded under bundles of sheets 9 that are discharged later after being bound together by the sheet binding process.

<Step S302>

While the succeeding control is performed, the progress determining portion 83 determines a progress state of the continuous printing process and the copy-unit printing process.

<Step S303>

While the succeeding control is performed, the paper jam determining portion 82 determines whether or not a paper jam has occurred.

<Step S304>

When the progress determining portion 83 determines that the succeeding control has been completed without occurrence of a paper jam, the control portion 8 executes the processes of steps S306 to S308 that are described below. It is noted that the succeeding control ends when the copy-unit printing process and the copy-unit sheet binding process end.

During a period from the start of the copy-unit control (S101) to the end of the succeeding control (S301), bundles of sheets 9 that have each been bound together by the sheet binding process are discharged to the second discharge tray 312, the bundles of sheets 9 corresponding to the number of copies that is obtained by subtracting one from the specified number of copies.

In addition, the sheets 9 discharged in step S204 of FIG. 6 are set in the sheet supplying portion 30 by the user at least until the succeeding control ends.

In the present embodiment, the sheets 9 discharged in S204 are set in a sheet supplying portion 30 that is different from a sheet supplying portion 30 used in the continuous printing process (S101, S301) and a supplementary printing process (S307) that is described below. More specifically, the sheet cassette 30*a* is used in the continuous printing process (S101, S301) and the supplementary printing process (S307) that is described below, and the sheets 9 discharged in step S204 are set in the manual feed tray 30*b*.

<Step S305>

On the other hand, when a paper jam is detected in the middle of the continuous printing process in the copy-unit printing process, the control portion 8 executes the paper jam control (see FIG. 6). This allows the succeeding control to be discontinued (step S201 of FIG. 6). After the paper jam control, the control portion 8 ends the post-jam-solution control.

It is noted that after the post-jam-solution control ends, the processes from step S301 are executed again.

<Step S306>

When the succeeding control ends after the paper jam is solved, the pre-processing control portion 84 causes the pre-processing portion 4 to execute the dummy feed process. In the dummy feed process, sheets 9 as many as a predetermined dummy feed number are conveyed from the sheet supplying portion 30 to the intermediate tray 60, without images being formed on the sheets 9. It is noted that the pre-processing control portion 84 that performs the process of step S306 is an example of the dummy feed control portion.

In the present embodiment, the pre-processing control portion 84 of step S306 causes the pre-processing portion 4 to convey sheets 9 from the manual feed tray 30*b*. It is noted that, as described above, in the continuous printing process (S101, S301) and the supplementary printing process (S307) described below, sheets 9 are conveyed from the sheet cassette 30*a*.

<Step S307>

After the dummy feed process, the pre-processing control portion 84 causes the pre-processing portion 4 to execute the supplementary printing process. In the supplementary printing process, images are formed on one or more sheets 9 conveyed from the sheet supplying portion 30, the images formed being images of remaining pages that are obtained by excluding pages corresponding to the dummy feed number of sheets 9 starting from the beginning page, from all pages that are the target of the continuous printing process.

In the supplementary printing process, sheets 9 are conveyed from the sheet cassette 30*a* that is different from the manual feed tray 30*b* from which sheets 9 are supplied in the dummy feed process (S306). With this configuration, it is possible to avoid such a problematic situation where sheets 9 used in the supplementary printing process are smeared by contacting sheets 9 on which images have been formed. It is noted that the pre-processing control portion 84 that executes the process of step S307 is an example of the supplementary printing control portion.

Suppose that the unit number of sheets is five, for example, and the dummy feed number is two. In that case, in the supplementary printing process, images are formed on three sheets 9 conveyed from the sheet cassette 30*a*, wherein the images formed are images of remaining pages obtained by excluding pages corresponding to two sheets 9 starting from the beginning sheet 9 from all pages corresponding to the unit number of sheets, five.

At the time when the processes of steps S306 and S307 are completed, the unit number of sheets 9 have been collected on the intermediate tray 60. More specifically, first, one or more sheets 9 have been collected on the intermediate tray 60 (step S306) when the continuous printing process is discontinued and on which images of pages starting from the beginning page have been formed. In addition, one or more sheets 9 are collected on the intermediate tray 60 on which images of succeeding pages have been formed by the supplementary printing process (S307).

<Step S308>

After the supplementary printing process, the post-processing control portion 85 causes the sheet binding portion 6 to execute the sheet binding process. This allows a bundle of sheets 9 which is the last copy of the sheet binding process, to be discharged to the second discharge tray 312.

With the end of step S305 or step S308, the post-jam-solution control ends. It is noted that the post-processing control portion 85 that executes the process of step S308 is an example of the post-supplementary-process control portion.

It is noted that the pre-processing control portion 84 and the post-processing control portion 85 perform the succeeding control (S301) to the pre-processing portion 4 and the sheet binding portion 6 after the paper jam is solved and before the dummy feed process (S306) is executed.

With the adoption of the image forming apparatus 10, if the continuous printing process is discontinued by an occurrence of a paper jam, sheets 9 with images formed thereon collected on the intermediate tray 60 are effectively used in a process that is resumed after the paper jam is solved (S306). As a result, compared to a case where the sheets 9 are discarded from the intermediate tray 60, it is possible to eliminate the wasteful consumption of sheets 9, developer and time.

The execution of the remaining sheet discharge control (S204) makes it possible to eliminate the effort and time of the user to take out the sheets 9 with images formed thereon from the intermediate tray 60.

Application Examples

According to the image reading portion 10 described above, the dummy feed number is automatically set by the progress determining portion 83 (S205). On the other hand, the dummy feed number may be set by an operation of the user. In this case, the user confirms the number of sheets 9 that had been discharged to the second discharge tray 312 when a paper jam occurred, and performs an operation of inputting that number.

As one example, the UI control portion 81 may set the dummy feed number in accordance with an operation performed on the operation portion of the operation display portion 80. The UI control portion 81 that executes this process is an example of the dummy feed number manual setting portion.

For example, the setting process may be executed before the process of step S301 or before the process of step S304.

In addition, in the image forming apparatus 10, the remaining sheet discharge control (S204 of FIG. 6) may be omitted. In this case, the user takes out the sheets 9 with images formed thereon from the intermediate tray 60 when the user performs a work of solving the paper jam. The sheets 9 taken out are set in the sheet supplying portion 30 before the dummy feed process (S306 of FIG. 7) is executed.

In addition, in the case where, for example, the image forming apparatus 10 includes only one second discharge tray 312, there may be a case where the discharge destination of sheets 9 in the remaining sheet discharge control (S204) and the discharge destination of sheets 9 in the succeeding control (S301) are the same.

Figure 7:
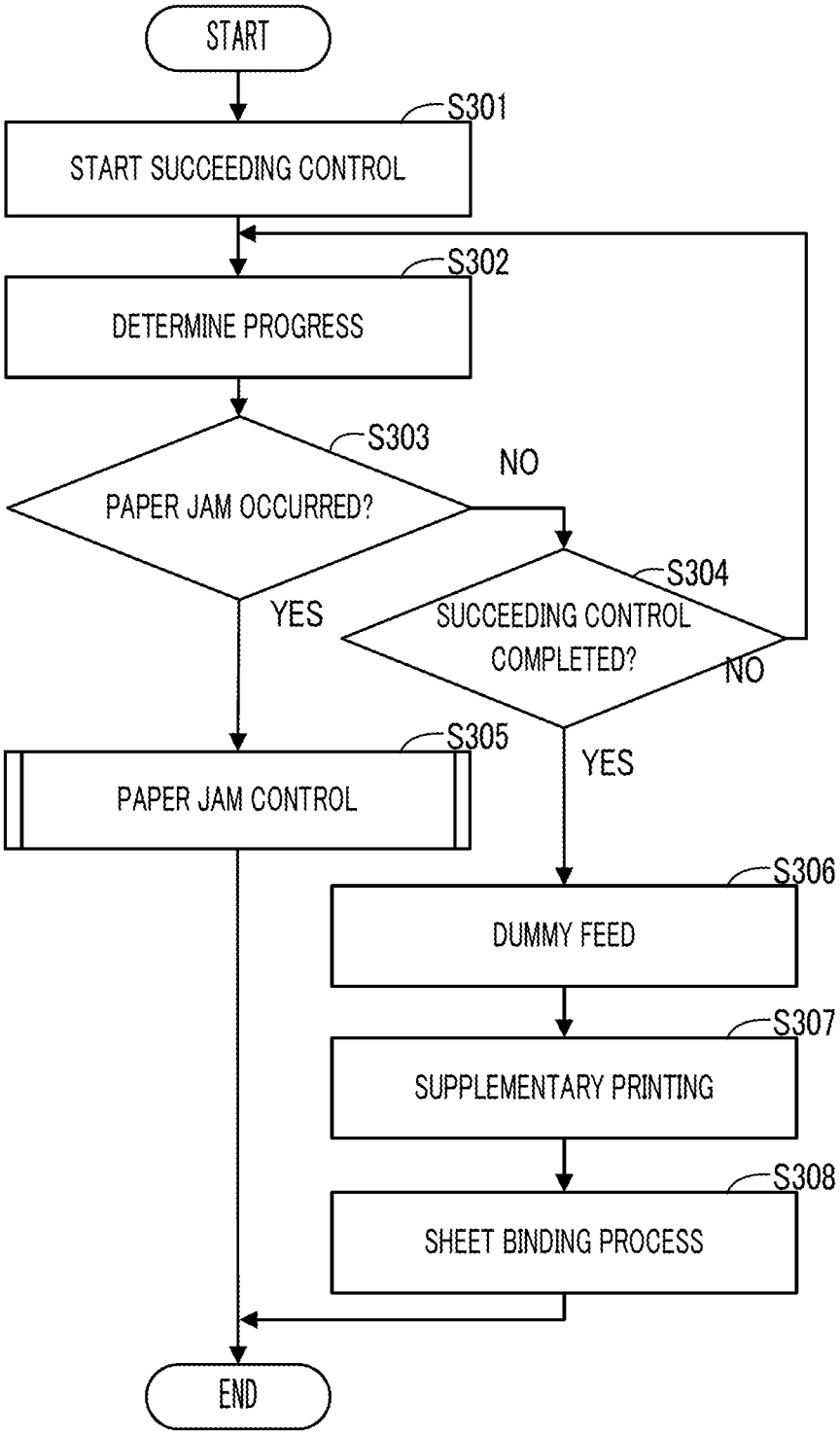
FIG. 7 is a flowchart showing an example of procedures of a post-jam-solution control in the image forming apparatus according to the embodiment of the present disclosure.

In addition, a same sheet supplying portion 30 may be used in the continuous printing process (S101, S301) and the supplementary printing process (S306 of FIG. 7). For example, the manual feed tray 30*b* may be used in both processes.

Figure 5:
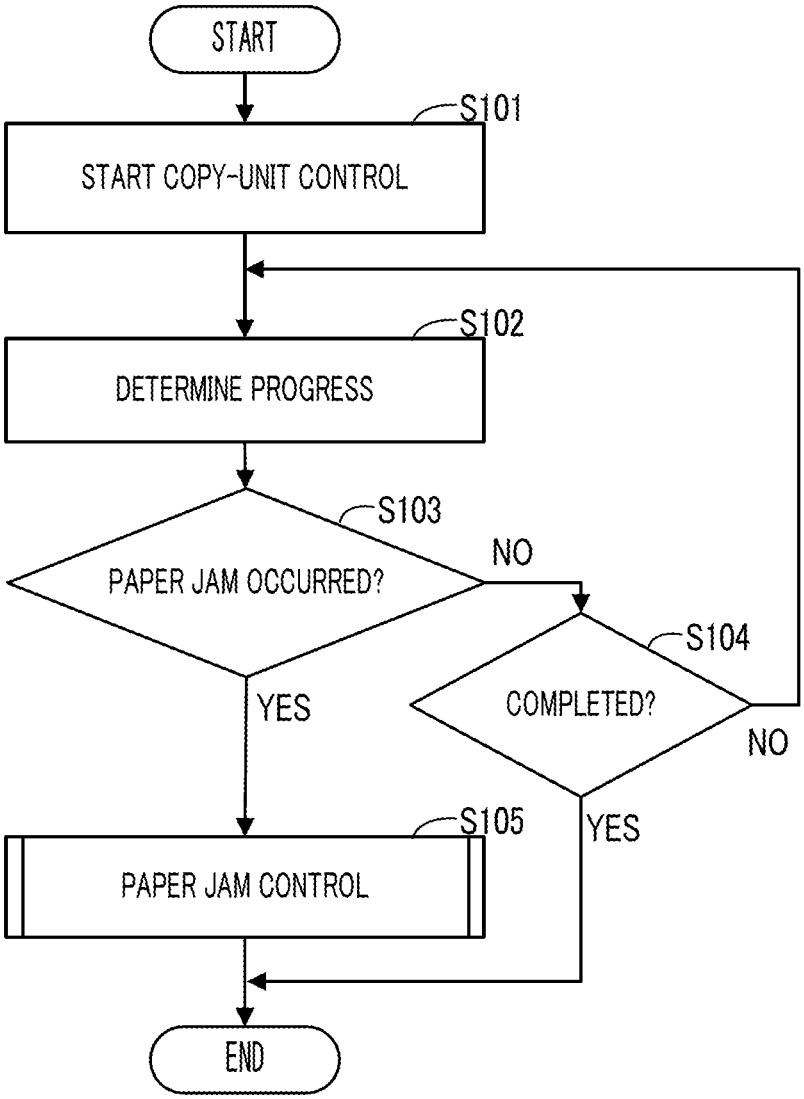
FIG. 5 is a flowchart showing an example of procedures of a copy-unit control in the image forming apparatus according to the embodiment of the present disclosure.

In addition, in a case where the sheet folding portion 7 performs the sheet binding work on a plurality of sheets 9 collected on the intermediate tray 70 by the continuous printing process, the control shown in FIG. 5 to FIG. 7 may be applied. In this case, the sheet binding process is an example of the post-processing, and the sheet folding portion 7 is an example of the post-processing portion.

When, in the control shown in FIG. 5 to FIG. 7, the process of the sheet folding portion 7 is adopted in place of the process of the sheet binding portion 6, during the post-processing, the sheet folding work is performed on the plurality of sheets 9 collected on the intermediate tray 70, and a bundle of sheets 9 folded by the sheet folding work are discharged to the third discharge tray 313. In this case, the remaining sheet discharge control (S204 of FIG. 6) may be omitted.

It is noted that the image forming apparatus and the method for controlling the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

at least one sheet supplying portion in which sheets are set;

a pre-processing portion including a sheet conveying portion configured to convey the sheets and an image forming portion configured to form images on the sheets, the pre-processing portion configured to execute a continuous printing process in which a plurality of pages of images are formed on a plurality of sheets while the plurality of sheets are conveyed one by one from the sheet supplying portion along a predetermined conveyance path;

an intermediate tray provided on a downstream side of the conveyance path in a conveyance direction, and configured to temporarily store the plurality of sheets with the images formed thereon;

at least one discharge tray provided on a downstream side of the intermediate tray in the conveyance direction, and configured to receive the plurality of sheets;

a post-processing portion configured to execute a post-processing in which to perform a predetermined work collectively on the plurality of sheets collected on the intermediate tray, and to discharge a bundle of sheets on which the work was performed, from the intermediate tray to the discharge tray;

a jam detecting portion configured to detect a paper jam of one or more sheets that has occurred in the conveyance path;

a discontinuation control portion configured to, when the paper jam is detected while the continuous printing process is performed by the pre-processing portion, discontinue the continuous printing process until the paper jam is solved;

a dummy feed control portion configured to, after the paper jam is solved, cause the pre-processing portion to execute a dummy feed process in which sheets as many as a predetermined dummy feed number are conveyed from the sheet supplying portion to the intermediate tray, without formation of images on the sheets;

a supplementary printing control portion configured to, after the dummy feed process, cause the pre-processing portion to execute a supplementary printing process in which images are formed on one or more sheets conveyed from the sheet supplying portion, the images being images of remaining pages that are obtained by excluding pages corresponding to the dummy feed number of sheets starting from a beginning page, from all pages that are a target of the continuous printing process; and a post-supplementary-process control portion configured to, after the supplementary printing process, cause the post-processing portion to execute the post-processing.

2. The image forming apparatus according to claim 1 further comprising:

a remaining sheet discharge control portion configured to, in a case where a number of sheets that had been conveyed to the intermediate tray during the continuous printing process before the continuous printing process was discontinued, is less than a unit number that represents a number of sheets processed in one execution of the continuous printing process, cause the post-processing portion to, before the dummy feed process is executed, discharge the sheets remaining in the intermediate tray without performing the work.

3. The image forming apparatus according to claim 1 further comprising:

a copy-unit control portion configured to cause the pre-processing portion to execute a copy-unit printing process in which the continuous printing process is repeated as many times as a specified number of copies that has been set in advance, and cause the post-processing portion to execute a copy-unit post-processing in which the post-processing is performed each time a unit number of sheets are collected on the intermediate tray, the unit number representing a number of sheets processed in one execution of the continuous printing process;

a succeeding copy number calculating portion configured to calculate a succeeding number of copies that is a number of copies that is obtained by subtracting, from the specified number of copies, a number of copies that is obtained by adding one to a number of copies on which the sheet binding process had been completed before the continuous printing process was discontinued; and a succeeding control portion configured to, after the paper jam is solved and before the dummy feed process is executed, cause the pre-processing portion and the post-processing portion to execute the copy-unit printing process and the copy-unit post-processing on the succeeding number of copies.

4. The image forming apparatus according to claim 3 further comprising:

a remaining sheet discharge control portion configured to, in a case where a number of sheets that had been conveyed to the intermediate tray during the continuous printing process before the continuous printing process was discontinued, is less than the unit number, cause the post-processing portion to, before the dummy feed process is executed, discharge the sheets remaining in the intermediate tray without performing the work.

5. The image forming apparatus according to claim 4, wherein the at least one discharge tray is a plurality of discharge trays, and the succeeding control portion causes the post-processing portion to discharge the bundle of sheets to a discharge tray that is different from the discharge tray to which the remaining sheet discharge control portion discharges the sheets.

6. The image forming apparatus according to claim 1, wherein the at least one sheet supplying portion is a plurality of sheet supplying portions, and the dummy feed control portion causes the pre-processing portion to convey sheets from a sheet supplying portion that is different from the sheet supplying portion used in the continuous printing process and the supplementary printing process.

7. The image forming apparatus according to claim 1 further comprising:

a dummy feed number automatic setting portion configured to set, as a dummy feed number, a number of sheets that had been conveyed to the intermediate tray during the continuous printing process before the continuous printing process was discontinued.

8. The image forming apparatus according to claim 1 further comprising:

an operation portion configured to receive operations of inputting information; and a dummy feed number manual setting portion configured to set the dummy feed number in accordance with an operation performed on the operation portion.

9. The image forming apparatus according to claim 1, wherein the work is a sheet binding work to bind a plurality of sheets.

10. The image forming apparatus according to claim 1, wherein the work is a sheet folding work to fold a plurality of sheets.

11. A method for controlling an image forming apparatus that includes:

a sheet supplying portion in which sheets are set;

a pre-processing portion including a sheet conveying portion configured to convey the sheets and an image forming portion configured to form images on the sheets, the pre-processing portion configured to execute a continuous printing process in which a plurality of pages of images are formed on a plurality of sheets while the plurality of sheets are conveyed one by one from the sheet supplying portion along a predetermined conveyance path;

an intermediate tray provided on a downstream side of the conveyance path in a conveyance direction, and configured to temporarily store the plurality of sheets with the images formed thereon;

a discharge tray provided on a downstream side of the intermediate tray in the conveyance direction, and configured to receive the plurality of sheets;

a post-processing portion configured to execute a post-processing in which to perform a predetermined work collectively on the plurality of sheets collected on the intermediate tray, and to discharge a bundle of sheets that have been subjected to the work, from the intermediate tray to the discharge tray; and a jam detecting portion configured to detect a paper jam of one or more sheets that has occurred in the conveyance path, the method comprising:

a step of, when a paper jam is detected while the continuous printing process is performed by the pre-processing portion, discontinuing the continuous printing process until the paper jam is solved;

a step of, after the paper jam is solved, causing the pre-processing portion to execute a dummy feed process in which a predetermined dummy feed number of sheets are conveyed from the sheet supplying portion to the intermediate tray, without formation of images on the sheets;

a step of, after the dummy feed process, causing the pre-processing portion to execute a supplementary printing process in which images are formed on one or more sheets conveyed from the sheet supplying portion, the images being images of remaining pages that are obtained by excluding pages corresponding to the dummy feed number of sheets starting from a beginning page, from all pages that are a target of the continuous printing process; and a step of, after the supplementary printing process, causing the post-processing portion to execute the post-processing.

* * * * *